US008210227B2

(12) United States Patent
Hoffmann et al.

(10) Patent No.: US 8,210,227 B2
(45) Date of Patent: Jul. 3, 2012

(54) CORD LOCK WITH IMPROVED WEAR SURFACE FOR AN ARCHITECTURAL COVERING

(75) Inventors: Brian M. Hoffmann, Louisville, CO (US); Michael S. Goldberg, Land O' Lakes, FL (US)

(73) Assignee: Hunter Douglas Inc., Pearl River, NY (US)

( * ) Notice: Subject to any disclaimer, the term of this patent is extended or adjusted under 35 U.S.C. 154(b) by 210 days.

(21) Appl. No.: 12/358,614

(22) Filed: Jan. 23, 2009

(65) Prior Publication Data

US 2009/0188634 A1 Jul. 30, 2009

Related U.S. Application Data

(60) Provisional application No. 61/023,679, filed on Jan. 25, 2008.

(51) Int. Cl.
*E06B 9/324* (2006.01)

(52) U.S. Cl. ..... 160/178.2; 160/84.05

(58) Field of Classification Search ..... 160/178.2, 160/173 R, 321, 84.04, 84.05; 24/136 R, 24/134 L See application file for complete search history.

(56) References Cited

U.S. PATENT DOCUMENTS 2,105,082 A * 1/1938 Johnson ..... 160/173 R
2,674,305 A * 4/1954 Moyer ..... 160/173 R
2,872,976 A * 2/1959 Lorentzen ..... 160/173 R
3,130,776 A * 4/1964 Van Thienen ..... 160/178.2
4,180,118 A * 12/1979 Vecchiarelli ..... 160/178.2
4,463,791 A * 8/1984 McClure ..... 160/178.2
4,475,580 A * 10/1984 Hennequin ..... 160/308
4,488,588 A * 12/1984 McClure ..... 160/178.2
4,646,808 A * 3/1987 Anderson ..... 160/178.2
4,660,612 A * 4/1987 Anderson ..... 160/173 R
4,913,210 A 4/1990 Colson et al.
4,913,213 A 4/1990 Schnelker
5,092,389 A * 3/1992 Tedeschi ..... 160/321
5,156,196 A * 10/1992 Corey et al. ..... 160/178.2
5,263,528 A * 11/1993 Patel ..... 160/178.2

* cited by examiner

*Primary Examiner* — David Purol
(74) *Attorney, Agent, or Firm* — Dorsey & Whitney LLP

(57) ABSTRACT

A cord guide system for extending the life of cords in a covering for an architectural opening provides long wear surfaces made of metal or ceramic which can be retrofitted into existing cord lock systems or molded into the system. The invention provides such long wear surfaces that can be used with different cord drive systems each of which permit an operator of a covering to manipulate the covering between extended and retracted positions while locking the covering in any position between fully extended and fully retracted. Cord guide surfaces are preferably made of metal or ceramic which are harder than conventional base materials used in cord lock systems and further have higher melting temperatures than either the base material for the cord lock system or the polyester cords conventionally used in coverings for architectural openings. In this manner, wear of the cord lock itself is minimized which in turn minimizes the wear of the lift cords and extends the life thereof.

15 Claims, 10 Drawing Sheets

CORD LOCK WITH IMPROVED WEAR SURFACE FOR AN ARCHITECTURAL COVERING

CROSS-REFERENCE TO RELATED APPLICATIONS

This application claims priority under 35 U.S.C. §119(e) to U.S. provisional application No. 61/023,679 filed on 25 Jan. 2008 and entitled Cord Lock with Wear Surface for an Architectural Opening. Application '679 is incorporated by reference as if fully described herein.

FIELD OF INVENTION

The present invention relates generally to a cord lock having an improved wear surface for a covering for an architectural opening.

DESCRIPTION OF THE RELEVANT ART

Generally, window coverings for architectural openings have multiple operating cords to lift and lower the coverings. The cords of the lift system, generally connected to the bottom rail, travel through a head rail, through a cord lock element and extend outwardly of the head rail for access to an operator or user of the covering. As the cords are translated by the operator, the cords must pass over and through the cord lock element to a set of locking dogs for lock capture of the cords to maintain the position of the shade material in a desired position by the user or operator. However, in the movement of the cords through the cord lock element, the cords wear and may even erode away at the material of the cord lock element. This is especially the case with the advent of very strong materials used for making the cords. In other words, the cords may be stronger or more abrasive than the material of the cord lock itself and thus erode, melt through friction, wear or groove the cord locks detrimentally. The wearing of the cord lock material is especially prevalent when the shade is repeatedly lifted or lowered by the user. Once the cord lock has been worn, it in turn detrimentally affects the cords themselves. This wear eventually produces a failure within the operating system. Therefore, it is the purpose of the present invention to create an improved cord lock to extend the life of the cord lock element.

SUMMARY OF THE INVENTION

A cord lock element having an improved wear or guide surface for contact with the lift cords in a covering for an architectural opening is described in several embodiments. The cord lock is mounted in the head rail of the covering. In several embodiments the cord lock has an entry portal and an exit portal for slideably receiving the lift cords. Additionally, the entry and exit portals have wear or guide surfaces therebetween across which the lift cords slide. The wear surfaces are hardened and are made of a high melting point material and, thus, improve the wear of the material of the cord lock base or body as well as the cords themselves as the cords are translated between the entry and exit portals. The cord lock may be of a type disclosed in U.S. Pat. No. 4,913,210 which is hereby incorporated by reference. The cord lock is fitted to one end or both ends of a head rail of the covering. Such shades use a minimum of two cords with the cords controlling the position of the shade as desired by the user. However, for purposes of simplicity, the description herein will describe cord locks at only one end of the head rail since the function of the cord lock at either end of the head rail is substantially the same.

During assembly and in order for the user to have access to the cords, the cords are routed through the cord lock at the entry portal and extend out of the exit portal of the cord lock, which is subsequently mounted to the head rail. After threading the cords in this manner, the cords are then in position to extend downwardly along one side of the covering for access to a user or operator. The cord lock conventionally has a set of dog elements, which captures or releases the cords as desired by the user. However in the cord lock of several embodiments herein described, improved wear surfaces are provided between the entry and exit portals so as to reduce the tendency of the cords to erode, wear or melt the body of the cord lock, which ultimately affects the life the cords through wear and/or melting from friction generated as the cords translate within the cord lock.

In one embodiment of the invention, the improved wear or guide surface is created with a smooth metal insert, which is harder and/or has a higher melting temperature than the plastic material conventionally used to form the base of conventional cord locks. The metal insert is press-fitted into the space between the entry and the exit portals of the cord lock. The insert is shaped to the surface of the cord lock so as to form a consistent path along which the cords are guided. The metal insert therefore forms a protective cover for the cord lock base, extending the life of the cords. The cords translate over the improved wear surface without abrading the softer and/or lower melting point material of the cord lock base. It is also important to note the improved surface extends slightly out of the exit portal defining a lip on the insert. This is important due to the fact that the cords being manipulated by the user are frequently moved not only axially along the length of the cords but also laterally in manipulating the cord lock and the lip further avoids wear to the base of the cord lock at the exit portal.

In another embodiment of the invention, the improved wear surface for the cord lock may be established with a ceramic as opposed to metal insert. The ceramic insert would function identically to the metal insert but would be molded rather than formed from a sheet of material.

A method for manufacturing the cord lock with either the metal or ceramic insert is described wherein the metal or ceramic insert is placed in the mold in a desired position before the base material for the cord lock is poured into the mold so that the base material is secured to the insert while leaving desired surfaces of the insert exposed for sliding engagement with the cords.

Still a further embodiment of the present invention is disclosed in a ceramic format wherein a ceramic piece having two arcuate guide surfaces, one for engagement with each run of an endless pull cord, is positioned adjacent to an entry/exit opening in a head rail so that the cord can easily and smoothly slide across the arcuate surfaces of the piece as it extends outwardly of the head rail to a position for manipulation by a user or operator of the covering. The endless pull cord is operatively connected to a conventional double acting clutch/break which permit circulatory movement of the cord in either direction but automatically prevents such movement unless it is being activated by the user or operator of the system.

Other aspects, features, and details of the present invention can be more completely understood by reference to the following detailed description of the disclosed embodiments when taken in conjunction with the drawings and the claims.

FIGURES

DETAILED DESCRIPTION OF THE INVENTION

Figure 1:
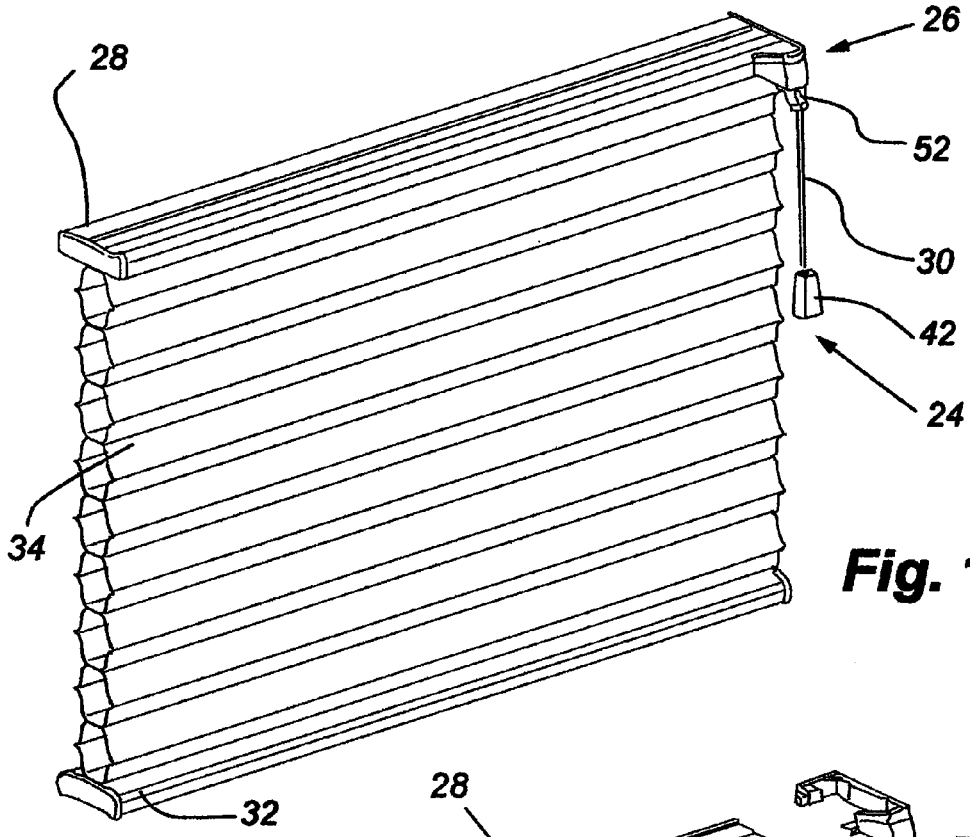
FIG. 1 is an isometric of a retractable cellular shade incorporating the present invention in an extended position.
Figure 2:
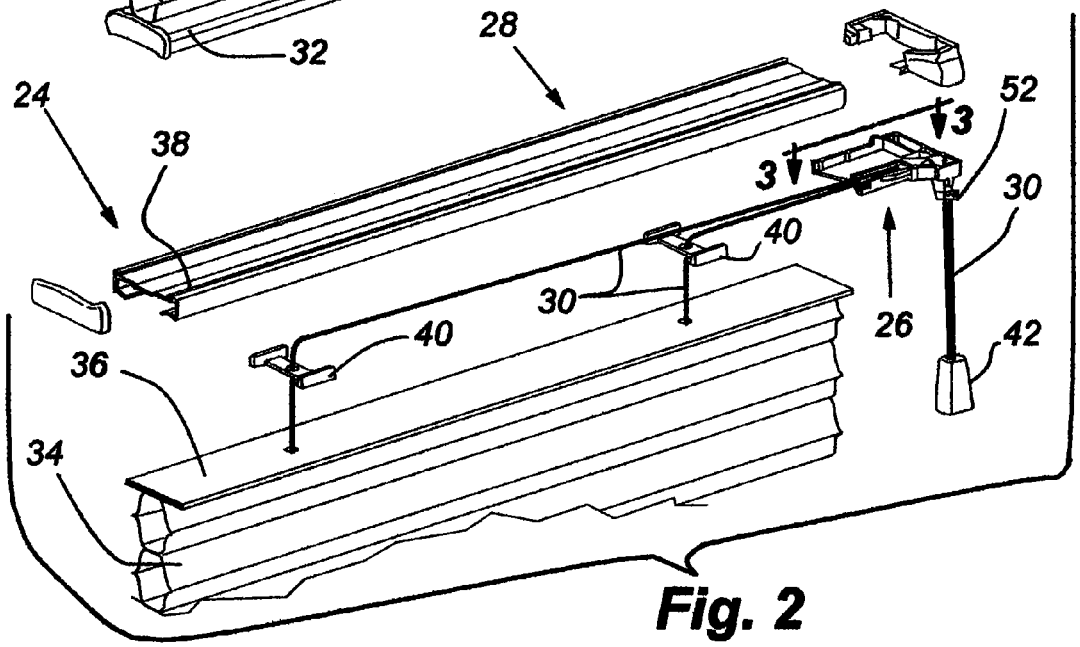
FIG. 2 is an exploded isometric showing a top of the covering of FIG. 1 and components of the head rail used therein.

A window covering 24 including a conventional cord lock which has been modified to incorporate an insert in accordance with the present invention is shown in FIGS. 1 and 2. The modified cord lock 26 is fitted into a head rail 28 for the covering in a conventional manner as disclosed for example in U.S. Pat. No. 4,913,213 which is commonly owned with the present application and is hereby incorporated by reference. Lift or operating cords 30 are connected to a bottom rail 32 of the covering and are routed through a retractable cellular shade 34 material upwardly into the head rail then horizontally along the head rail where they exit through the cord lock 26 and extend downwardly along the side of the architectural opening for easy access to a user or operator of the covering. Within the head rail, a horizontal base strip 36 is provided for supporting the cellular shade material and for being removeably secured to a support channel 38 of the head rail and clips 40 are positioned on the base strip through which the lift cords extend before passing horizontally to the cord lock. At the free end of the cords, an easily accessible tassel 42 is secured to the cords in a conventional manner.

Without getting into a lot of detail on the conventional cord lock from which the modified cord lock 26 is made as its operation is described fully in the aforenoted U.S. Patent, the cords 30 extend horizontally into the cord lock and into an entry portal 44 before passing across first 46 and second 48 cord guide surfaces in their passage to an exit portal 50 which opens downwardly. After passing through the exit portal, they pass through a conventional lock dog 52 which is conventionally manipulated between locking and unlocking positions by lateral movement of the cords at the free or tassel end of the cords. In other words, by laterally moving the cords in one direction, the lock dog grips the cords to prevent them from further movement but by moving the cords in an opposite lateral direction they are freed for sliding movement through the lock dog as when raising or lowering the covering. The first and second cord guide surfaces in conventional cord locks are made of the same material as the entire base 54 of the cord lock which is abraded and worn by the cords as they slide there across in operation of the covering. As they wear the cord guide surfaces, the surfaces become roughened and unduly abrade the cords themselves thereby shortening the life of the cords and creating a malfunction in the covering.

Figure 6:
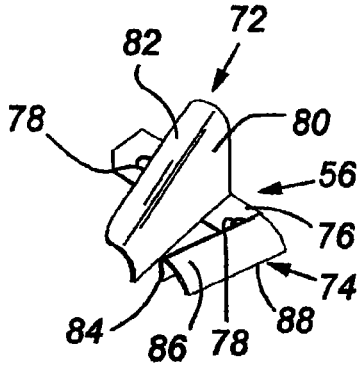
FIG. 6 is an isometric of the metal insert before being molded into the cord locks as seen in FIG. 5.
Figure 5:
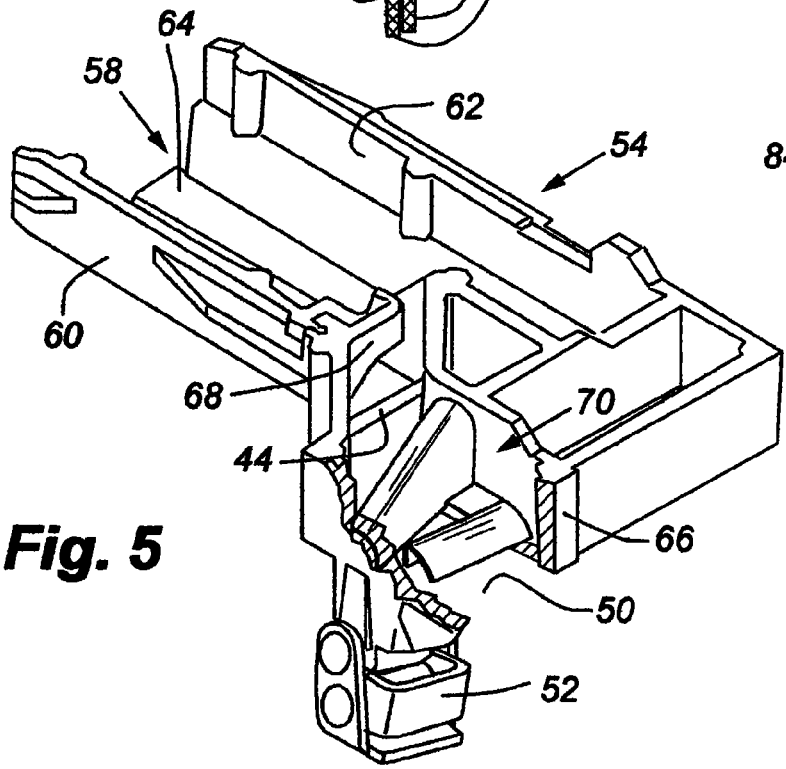
FIG. 5 is an isometric similar to FIG. 4 with portions removed to better illustrate the positioning of the metal insert in the cord lock.

Pursuant to a first embodiment of the present invention, a one piece metal insert 56 shown in FIG. 6 and shown positioned in FIG. 5 within a conventional cord lock base 54 is made of a material that is substantially harder than the base material having the first 46 and second 48 cord guide surfaces. The durometer hardness of the metallic material from which the insert 56 is made is preferably in excess of 88 Rockwell B while a maximum durometer hardness for a conventional cord lock body made of a plastic material is typically around 109 Rockwell M. Further, the metal insert preferably has a melting temperature in excess of 2500 degrees Fahrenheit whereas a conventional base material softens at approximately 422 degrees Fahrenheit.

As possibly seen best in FIG. 5, the cord lock base 54 has a cord channel 58 which is defined by a first wall 60 and a second wall 62. From a first edge 64 of the channel, the channel can be seen to continue to the right to the entry portal 44 even though the channel does not actually terminate until it reaches an end wall 66. The entry portal is defined as an opening under a tang 68 which is connected to the upper edge of the first wall 60 so as to extend perpendicularly therefrom. The tang does not extend all the way to the second wall 62 but rather forms a gap between the tang and the second wall so as to provide easy access for threading the cords.

A generally square opening or space 70 is defined in the base 54 of the cord lock between the entry portal 44 and the exit portal 50 which communicates with both the entry and exit portals. The exit portal of course opens downwardly through the cord lock body in substantial alignment with the lock dog 52.

Figure 7:
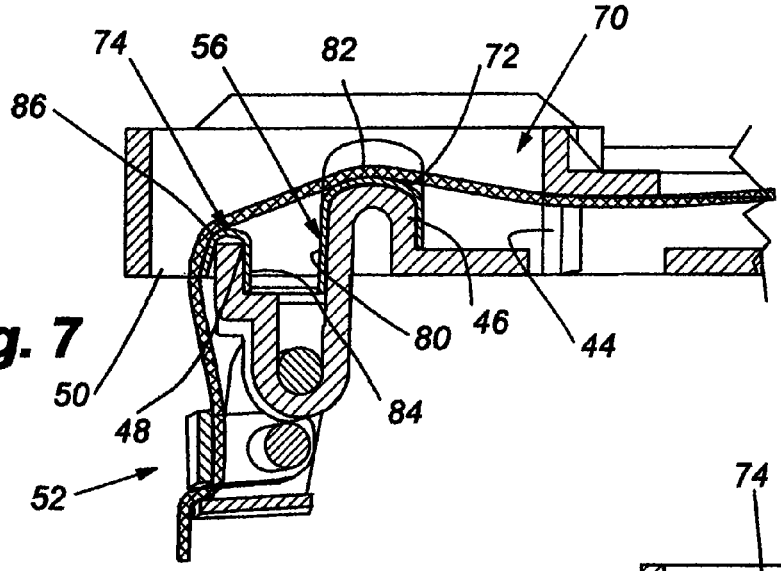
FIG. 7 is fragmentary section taken along line 7-7 of FIG. 3.
Figure 9:
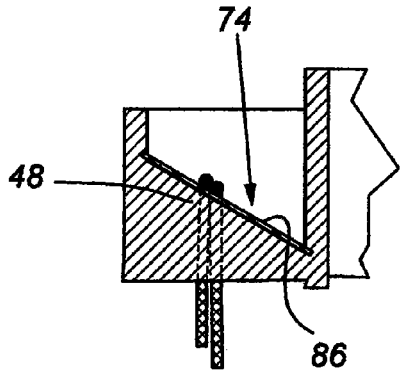
FIG. 9 is a fragmentary section taken along line 9-9 of FIG. 3.
Figure 8:
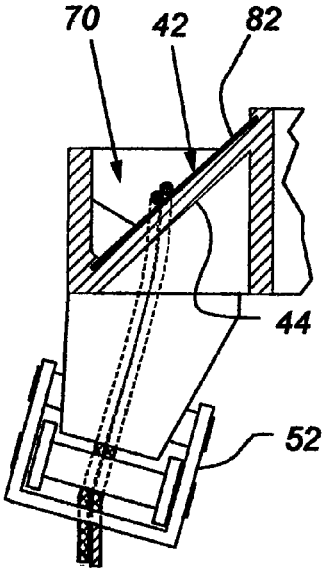
FIG. 8 is a fragmentary section taken along line 8-8 of FIG. 3.
Figure 10:
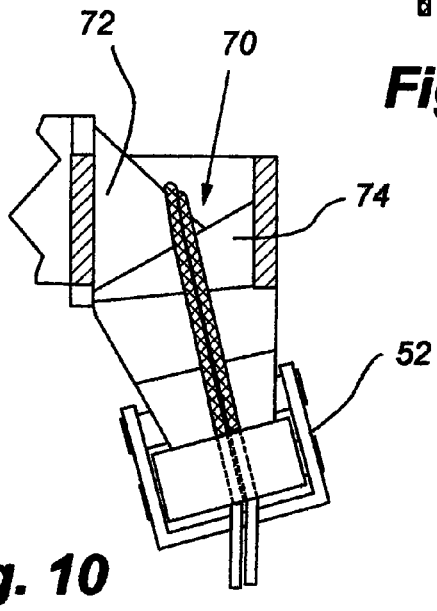
FIG. 10 is a fragmentary section taken along line 10-10 of FIG. 3.
Figure 12:
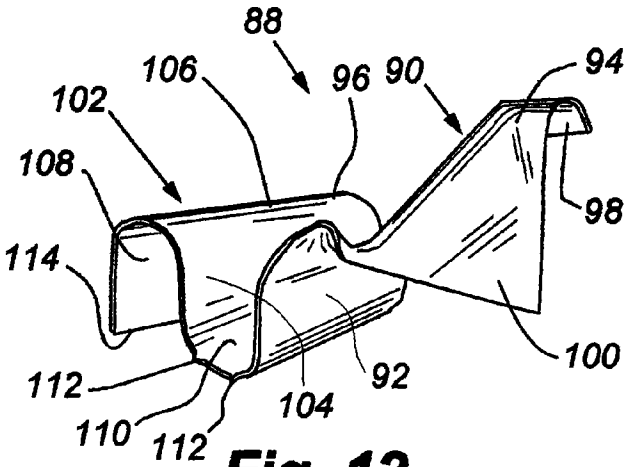
FIG. 12 is an isometric of the metal insert of FIG. 11 viewed from a first angle.
Figure 13:
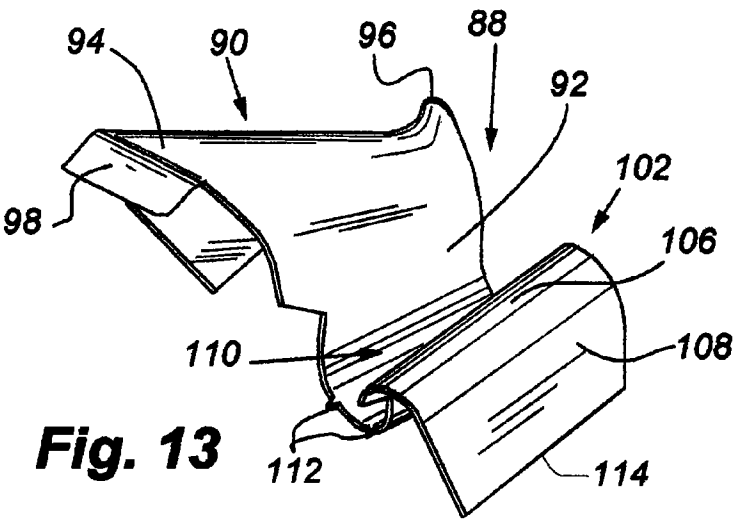
FIG. 13 is an isometric of the metal insert of FIG. 11 viewed from a different angle.

The first 46 and second 48 cord guide surfaces which are probably best seen in FIG. 7 are upwardly convex with the first cord guide surface forming an angle relative to horizontal while the second cord guide surface forms an angle relative to horizontal in an opposite direction. The two cord guide surfaces thereby define a cord path thereacross to confine and guide the cords from the entry portal to the exit portal. The cords pass across both the first and second cord guide surfaces as seen for example in FIGS. 4 and 7-10 in their passage between the entry portal 44 and the exit portal 50 in the cord lock body.

The insert 56 as seen in FIG. 6 is adapted to be positioned and seated within the generally square opening 70 in the cord lock base 54 and is preferably molded in position during the molding process for the cord lock base itself. When molding the insert into the cord lock base, it is configured as seen in FIG. 6 to have a first lobe 72 corresponding to the first cord guide surface 46 of the plastic base of the cord lock body and a second lobe 74 corresponding to the second cord guide surface 48 of the cord lock base. The first and second lobes or guide surfaces of the insert are interconnected by a horizontal flat strap 76 having holes 78 therethrough for a purpose to be described hereafter.

Figure 3:
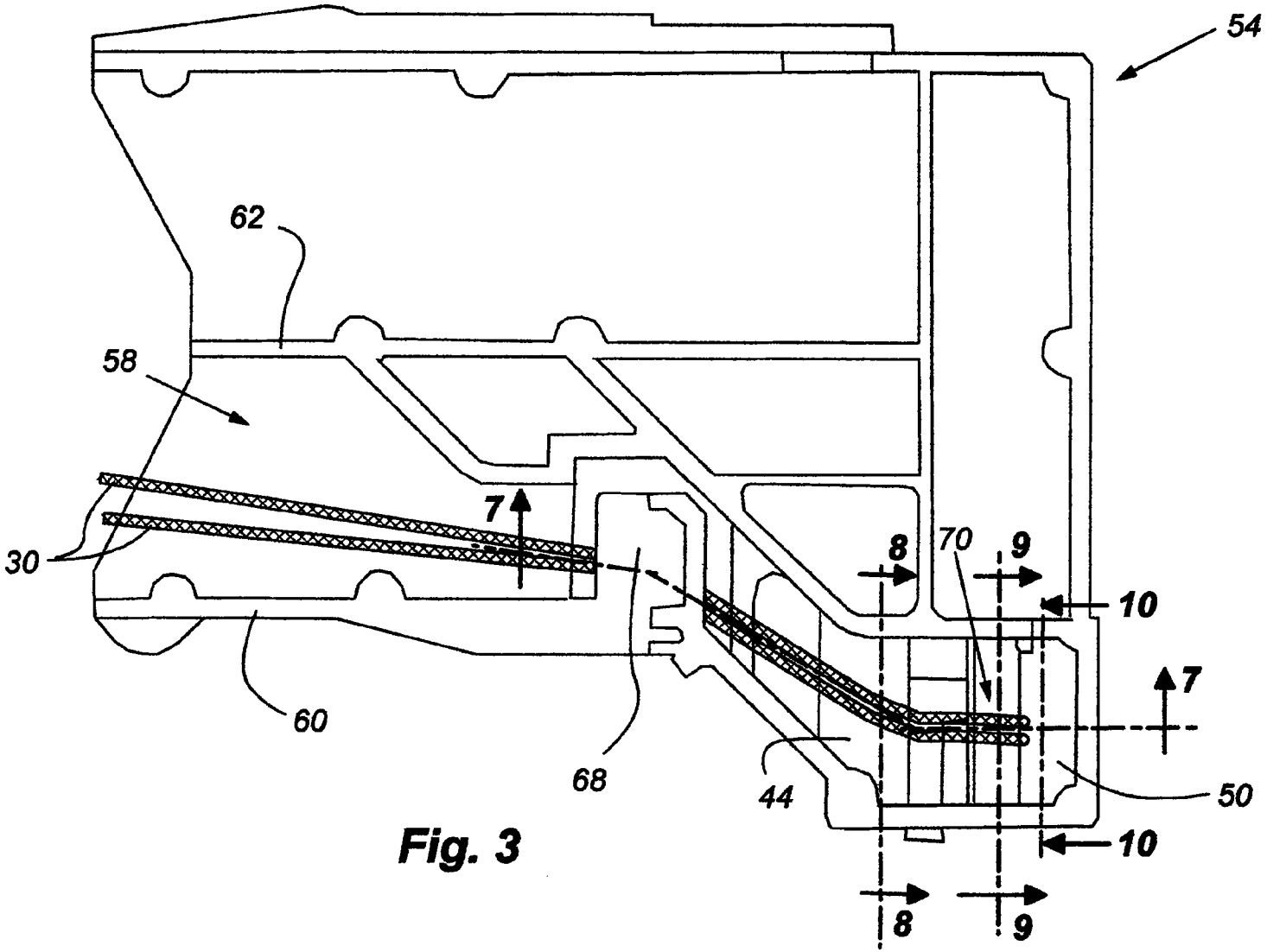
FIG. 3 is an enlarged fragmentary section taken along line 3-3 of FIG. 2.
Figure 4:
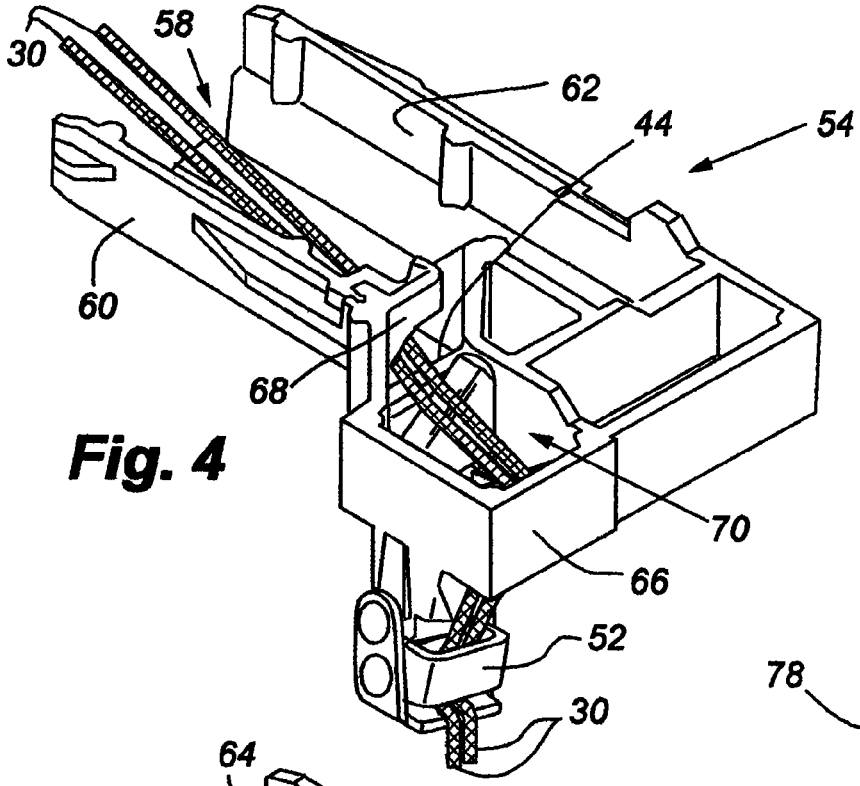
FIG. 4 is an isometric looking downwardly on a cord lock used in a first embodiment of the present invention and wherein a metal insert has been molded therein.

The first lobe 72 as seen in FIG. 6 has a vertical wall 80 and a continuous upwardly convex arcuate wall 82 which forms for example an angle of approximately 30 degrees with horizontal so as to conform with the first cord guide surface 46 of the cord lock base 54. The second lobe 74 also has a vertical wall 84 in confronting relationship with the vertical wall 80 of the first lobe and further includes an upwardly convex arcuate or curved wall 86 whose free edge or lip 88 extends downwardly to the bottom edge of the cord lock base through the exit portal 50 to prevent the cords from wearing the side walls of the exit portal of the base. The vertical walls of the first and second lobes also form a different angle relative to an imaginary vertical plane (not shown) so that they form an angle relative to each other as do the first and second cord guide surfaces of the cord lock base as is desirable for guiding the cords (FIGS. 3, 4 and 10) as they pass from the entry portal to the exit portal of the cord lock body.

The insert 56 as illustrated in FIG. 6, as mentioned previously, is designed to be molded into the cord lock base 54 and is done so in a conventional insert molding process where the mold (not shown) includes pins which support the insert 56 within the mold with the pins cooperating with the holes 78 in the horizontal strap to hold the strap in an elevated position while assuring the curved or arcuate walls 82 and 86 of the first and second lobes engage the walls of the mold. In this manner, when the material from which the base of the cord lock is molded is injected into the mold, the plastic will surround the strap to secure the insert in the desired position within the base while assuring that the arcuate walls of the first and second lobes remain exposed for sliding engagement with the cords in the completed cord lock. As mentioned, such an insert molding process is well known in the art and accordingly a detailed description more comprehensive than the above is not felt necessary. Suffice it to say that once the insert has been molded into the base of the cord lock, it is positively positioned within the generally square opening 70 in the cord lock base with the curved metallic lobes of the insert being exposed across the tops of the first and second cord guide surfaces of the base.

In a second embodiment of the invention, the insert 56 as seen in FIG. 6 which has been described previously as being made of a metal material, could be made of a ceramic material and again molded into the base as described previously so that the exposed curved walls or lobes of the insert were ceramic rather than metal. If ceramic were used, it would preferably have a hardness in excess of six on the Mohr scale and its melting temperature would be approximately 3,000° F. The melting temperature of a conventional polyester cord used in coverings for architectural openings is approximately 475° F., so it will be appreciated that by providing a surface that is relatively hard and/or has a melting temperature higher than the cord lock base or the cord itself, a long-wearing cord lock surface is obtained. This will minimize the generation of heat through friction, which could melt the cord. It will also avoid a roughened or grooved surface that could prematurely abrade the cord.

In a further embodiment of the present invention shown in FIGS. 11 through 18, the insert 88 is configured similarly to that of FIG. 6 with minor variations due to the fact that the insert of FIGS. 11 through 18 is adapted to be removably inserted into a pre-molded base 54 having the same configuration as that described previously and shown for example in FIG. 11. The insert for this embodiment could again be made of metal or ceramic and configured so as to have a first lobe 90 having a generally vertical wall 92 that is continuous with an upwardly convex curved wall 94 having an upturned lip 96 at its front or lower end for controlling the cords and a tab 98 at its rear or upward end for helping retain the insert in the desired position within the cord lock base. A skirt 100 forms an outer surface for the upwardly convex curved wall 94 again to facilitate holding the insert in position. A second lobe 102 also has a vertical wall 104 confronting the vertical wall 92 of the first lobe and an upwardly convex generally horizontally curved or arcuate wall 106 conforming to the second cord guide surface 48 of the cord lock base. The upwardly convex curved surface of the second lobe also has a downwardly extending skirt 108 to help hold the insert in position. Between the first and second lobes is a continuous trough 110 forming a generally downwardly convex surface having longitudinally extending barbs 112 which grip the base material of the cord lock to also assist in holding the insert in position.

Figure 11:
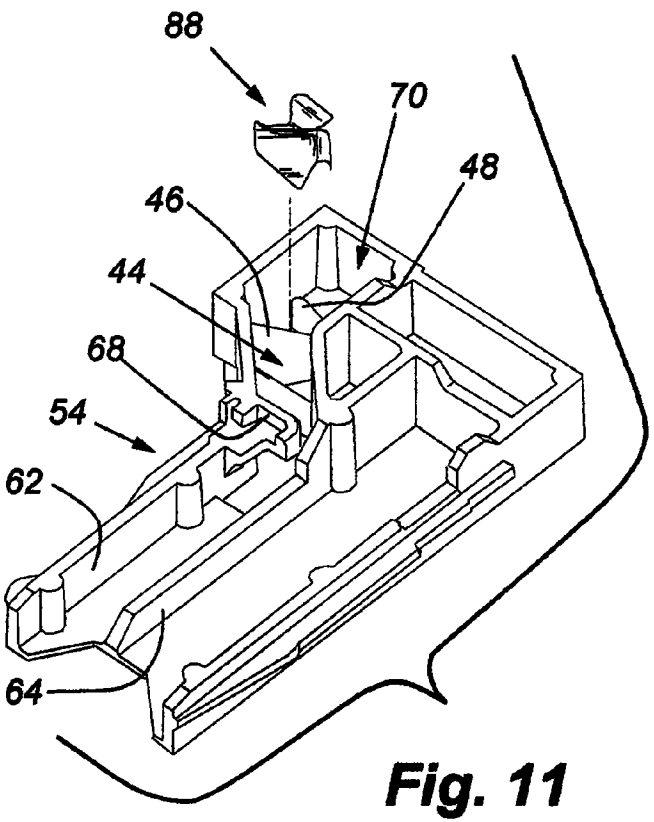
FIG. 11 is an isometric similar to FIG. 5 looking downwardly on the cord lock from a different angle and with a second embodiment of a metallic insert being separated from the remainder of the cord lock.
Figure 15:
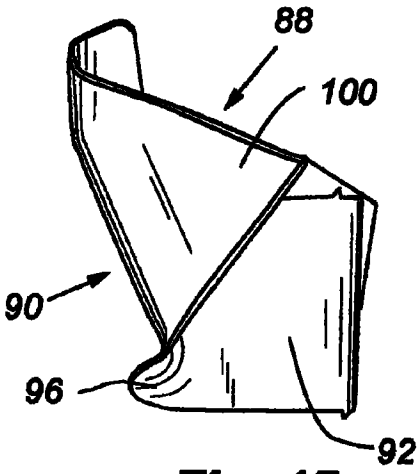
FIG. 15 is a right side view of the insert as viewed in FIG. 14.
Figure 14:
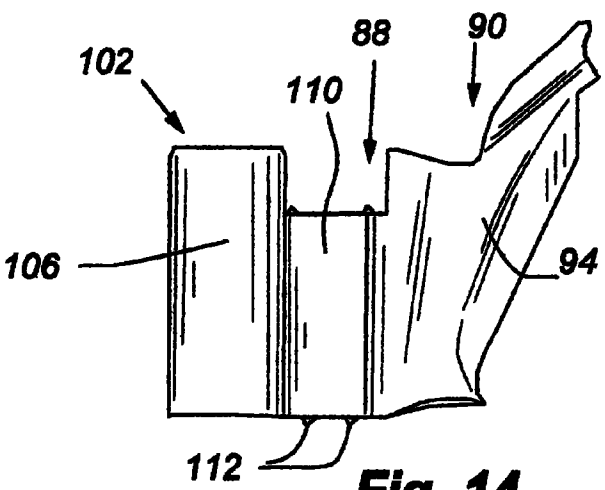
FIG. 14 is a top plan view of the metal insert of FIG. 11.
Figure 18:
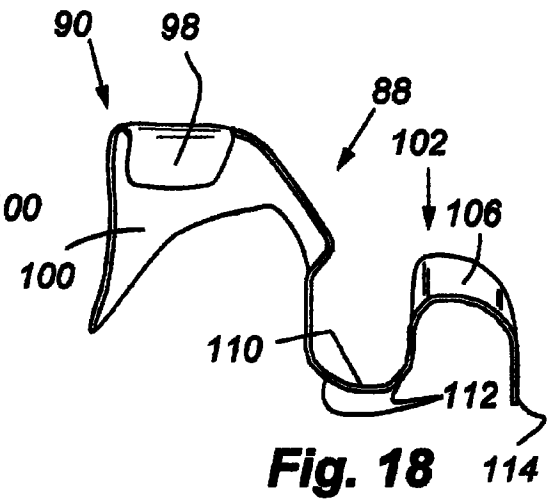
FIG. 18 is a rear elevation of the insert as viewed in FIG. 14.
Figure 17:
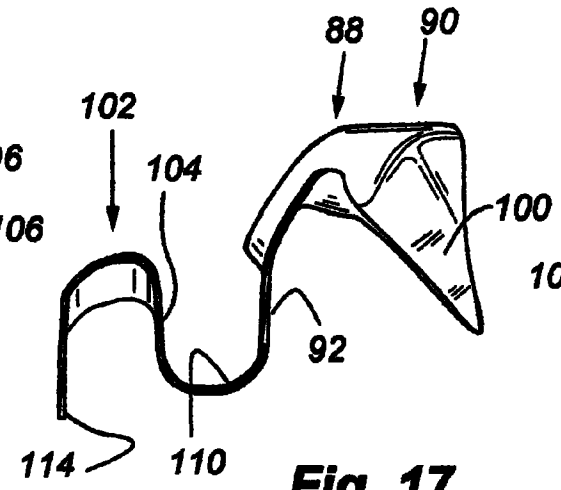
FIG. 17 is a front elevation of the insert as viewed in FIG. 14.
Figure 16:
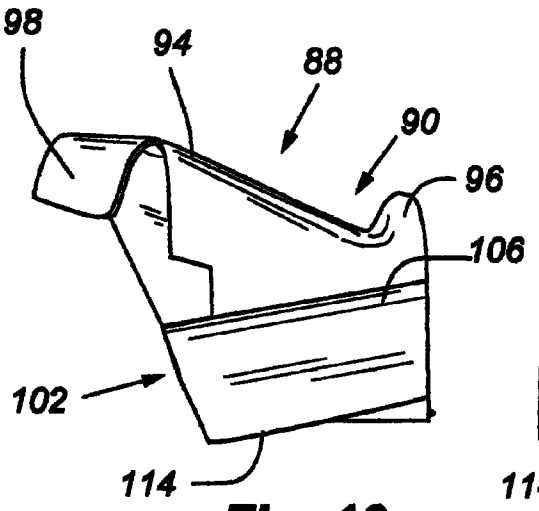
FIG. 16 is a left side elevation of the insert as viewed in FIG. 14.

With reference to FIG. 11, the insert 88 can be seen elevated from the base in an orientation where it can be merely lowered into the generally square opening 70 within the cord lock base 54 so that the first 90 and second 102 lobes of the insert overlie the first and second cord guide surfaces 46 and 48 of the base so as to expose the low friction and long wear surfaces of the insert to the cords 30 as they slide thereacross in their movement between the entry 44 and exit 50 portals of the base. The outer skirt 108 of the second lobe also extends downwardly to the bottom edge of the cord lock base so as to define a lip 114 that protects the cord lock base at the exit portal from undue wear as the cords are shifted laterally as well as axially in operation of the covering by a user or operator.

Referring next to FIGS. 19 through 22, a still further embodiment of the invention is illustrated. In this embodiment, a different but conventional system for controlling a closed loop cord 116 during manipulation of a covering 118 between extended and retracted positions is utilized. Further, a ceramic piece 120 guides the cord from the interior of the head rail 122 downwardly through an entry/exit portal 124 where the cord can be manipulated by shifting the downwardly extending runs of the looped cord in opposite vertical or circulatory directions to raise or lower the covering.

Figures 19, 20:
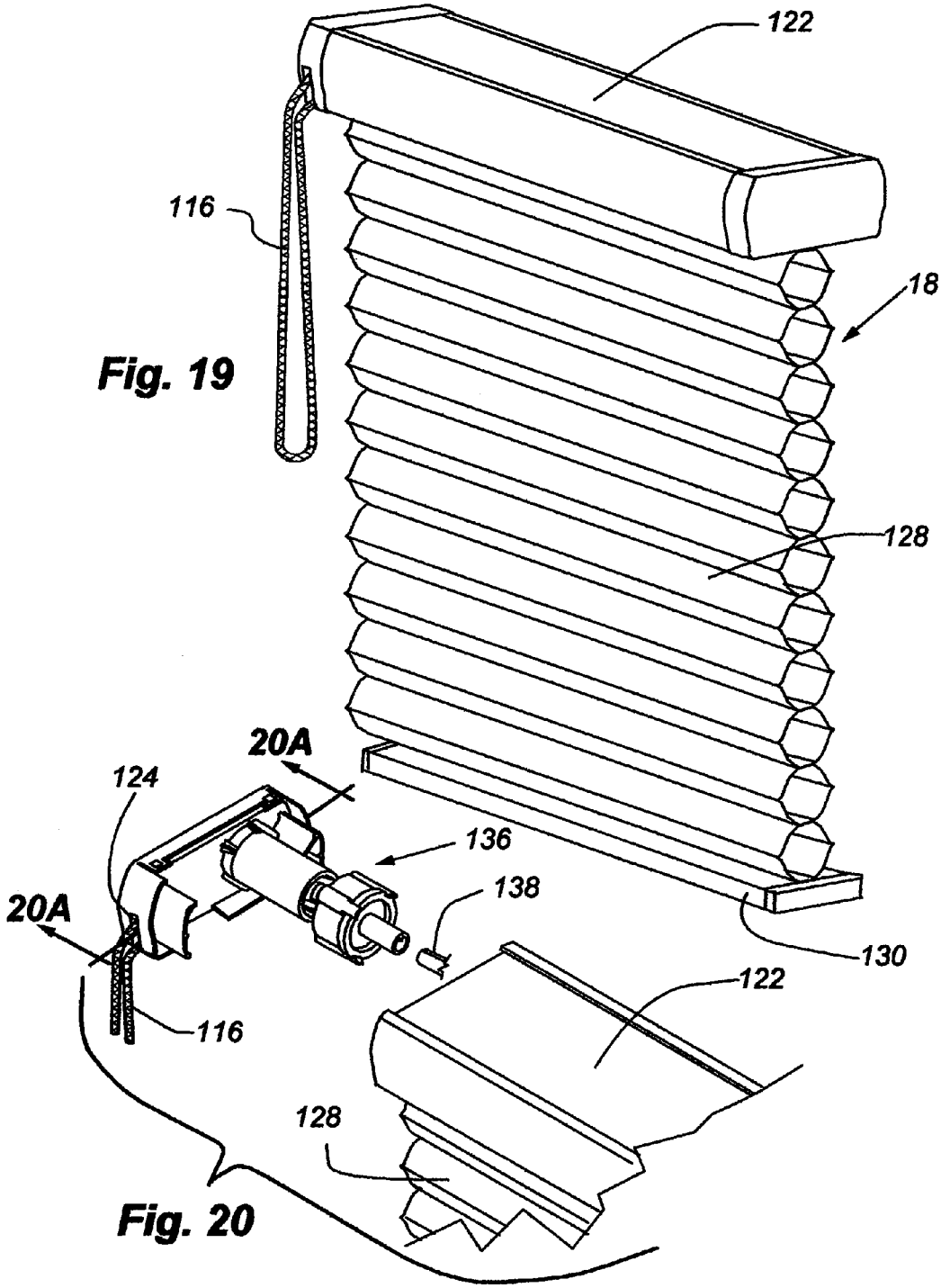
FIG. 19 is an isometric of a retractable cellular covering similar to that shown in FIG. 1 which incorporates still a further embodiment of a cord lock in accordance with the present invention.
FIG. 20 is an enlarged exploded isometric showing the left end of the head rail of the covering of FIG. 19.
Figure 20A:
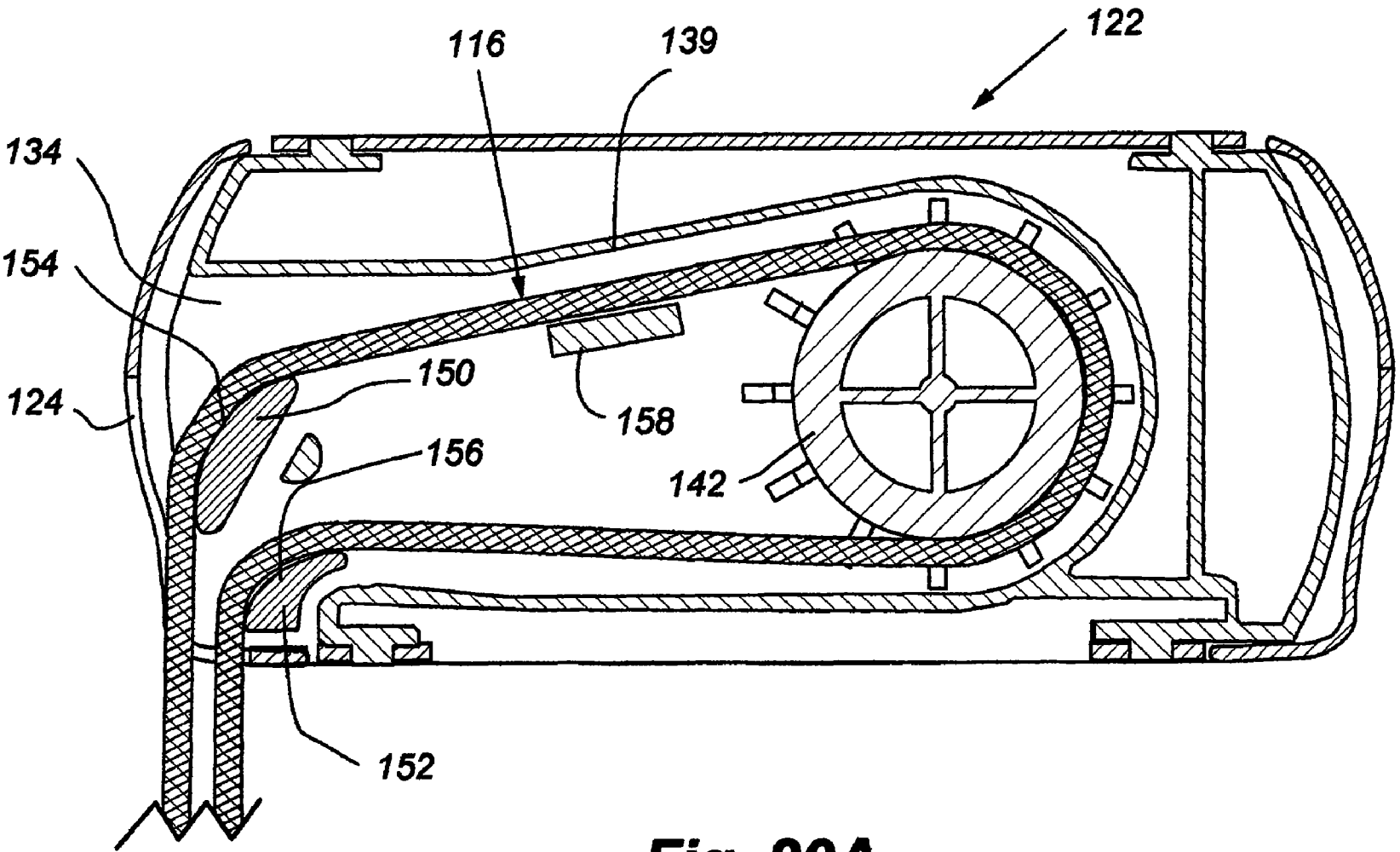
FIG. 20A is an enlarged fragmentary section taken along line 20A-20A of FIG. 20.
Figure 21:
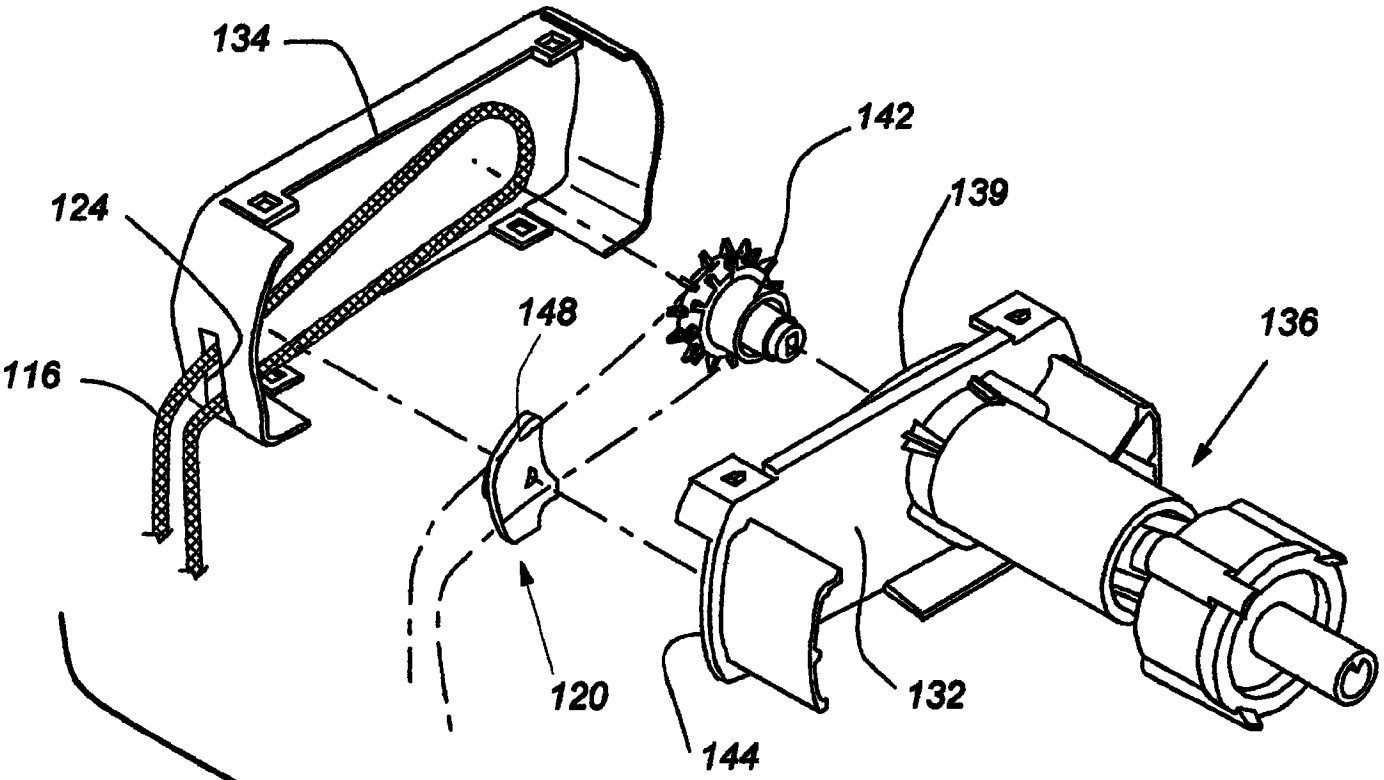
FIG. 21 is an enlarged exploded isometric of the cord lock as viewed in FIG. 20.
Figure 22:
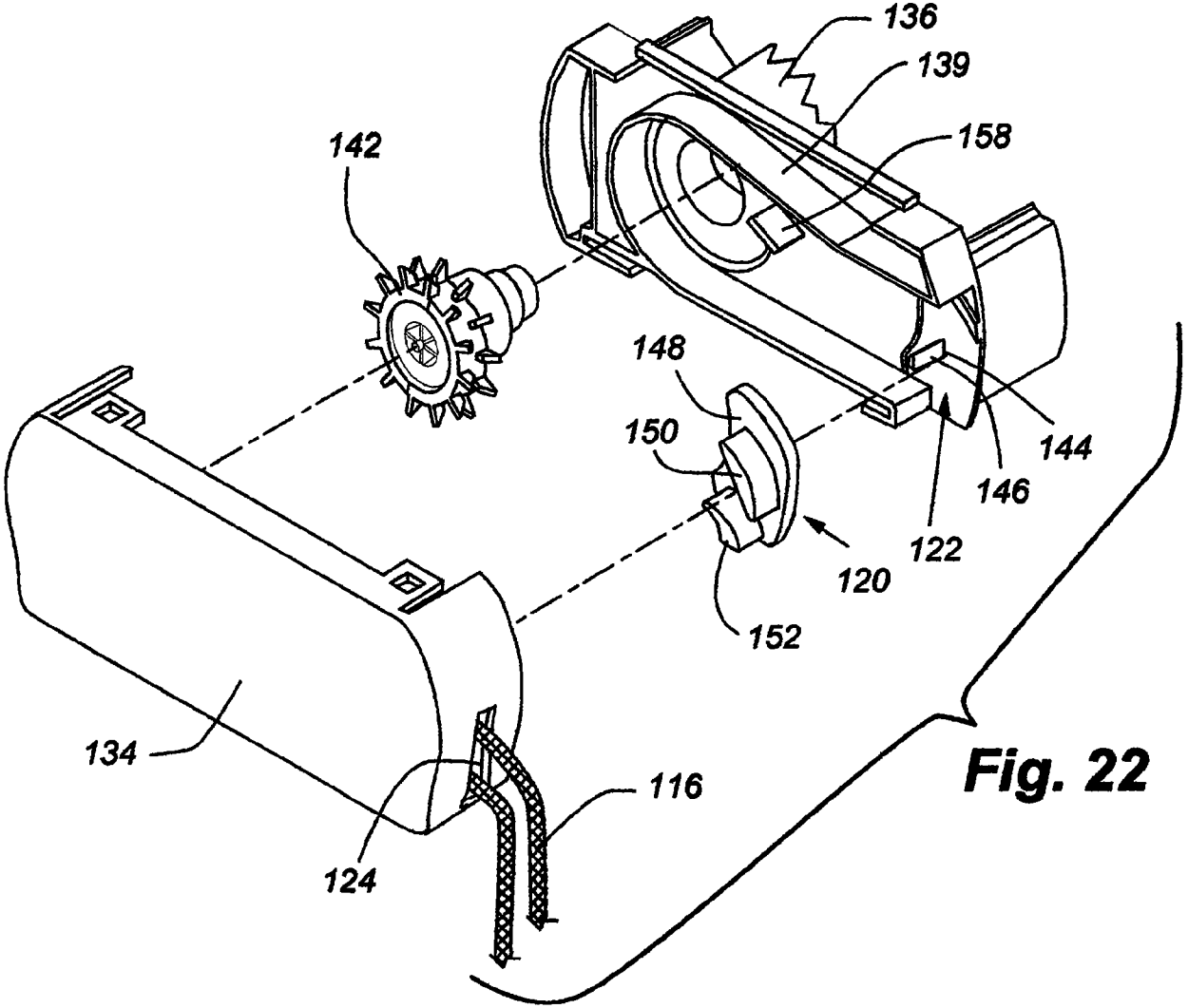
FIG. 22 is an exploded isometric similar to FIG. 21 as viewed from a different angle.

Reference to FIG. 19 shows the covering 118 in an extended position where the covering has a head rail 126 that supports a retractable cellular shade material 128 having a bottom rail 130 that serves as a ballast. Within the head rail at the left end as illustrated in FIGS. 19 and 20 (but which could be at the right end depending upon the architectural opening in which the covering is mounted) includes the control system for the covering. The control system is best illustrated in FIGS. 20 through 22. The control system can be seen to be mounted on a left end wall 132 of the head rail which has a removable end cap 134 that provides a closure and desirable aesthetics for the covering. On the left end wall of the head rail, a conventional double-acting clutch/brake system 136 is supported on an inner surface of the end wall and is operatively connected to a roller 138 about which lift cords (not shown) can be wrapped. The roller might also serve to wrap the shade material itself if it were of the wrappable type. A cord shield 139 is integrally formed on the outer surface of the left end wall.

The double-acting clutch/brake system 136 as mentioned is a conventional system which can be rotated in one direction or another upon the application of torque thereto but when the torque is not applied, the clutch/brake system serves to retain the roller in a predetermined position so that the shade can be positioned at any desired position between fully retracted and fully extended. Typically such double-acting clutch/brake systems include two coiled springs which are reversibly wrapped about the roller and have tangs which are selectively engagable to release one coiled spring at a time allowing the roller to rotate in one selected direction or the other but when the tangs are not engaged, the springs grip the roller to prevent its rotation in either direction.

On the free or output end of the clutch/brake system 136, a cog wheel 142 is keyed to the clutch/brake system with the cog wheel engaging the endless lift or operating cord 116 so as to rotate in unison with the cord. The cord when extending around the cog wheel which rotates about a horizontal axis supports the runs of the lift or operating cord in vertically spaced relationship from each other.

Removably seated in a recess 144 in the outer surface of the left end wall 132 of the head rail 126, which is typically made of a plastic material, is the insert or guide piece 120 which is positively but removably positioned in the recess on a horizontal mounting pin 146. The guide piece has a base 148 which fits and conforms to the recess 144 in the left end wall of the head rail and upper 150 and lower 152 arcuate guide plates each of which have upper curved or arcuate surfaces 154 and 156 respectively about which one run of the endless cord can extend and slidably pass. These curved surfaces while being angled slightly from an upper rear edge to a lower front edge, are transversely horizontal so that the cords remain on the curved surfaces which are in alignment with upper and lower segments of the cog wheel. In this manner, the upper and lower runs of the endless cord within the head rail extend from the cog wheel across the upper and lower guide plates of the guide piece where they smoothly transcend from a horizontal direction to a vertical direction as they extend through a L-shaped entry/exit slot in the end cap 134 of the head rail. The left end wall 132 of the head rail also includes a support plate 158 which helps to support the upper run of the endless cord within the head rail so that it transcends smoothly across the upper curved surfaces of the guide piece.

As with the earlier described uses of ceramic, the ceramic material preferably has a hardness in excess of six on the Mohr scale and its melting temperature is desirably at approximately 3,000° F. As mentioned, the melting temperature of conventional polyester cords used in window coverings is approximately 475° F. so it is appreciated that the provision of a relatively hard surface having a melting temperature higher than the cord base or the cord provides for a longer wearing cord lock surface for the cords. This minimizes the generation of heat through friction, which could melt the cord. It also avoids a roughened or grooved surface that could prematurely abrade the cord.

While the guide piece is described as being made of a ceramic material, it could be made of a metal having the characteristics of the previously described metal inserts which would also extend the life of the lift cords.

While a preferred embodiment of the invention has been discussed in detail, this should not be considered a limitation on the invention, but merely exemplary thereof. The invention is to be limited only by the following claims.

The invention claimed is:

1. A cord lock for a covering for an architectural opening wherein said covering includes a headrail, a shade material, and a control cord comprising:

a cord lock mountable on said headrail for securing said lift cord in a desired position relative to said headrail, and said cord lock having a base made of a preselected material, said base including a substantially planar leg;

a first cord portion extending upward from a first end of said leg;

a bottom portion positioned below and extending from a second end of said first cord portion opposite of said leg;

a second cord portion connected to said bottom portion and terminating in a free end; and a cord guide operably connected to said base for guiding said control cord and including a first lobe having a first convex arcuate top wall having a length of extension, and positioned adjacent a top surface of said first cord portion, such that a bottom portion of said first lobe is substantially coextensive with said top surface of said first cord portion;

a strap extending from a terminal end of said first lobe;

a second lobe having a side extending upwardly from and substantially perpendicular to said strap and having a second convex arcuate top wall having a length of extension where the length of extension of the second convex arcuate top wall forms an angle relative to said length of extension of the first convex arcuate top wall, and an end forming a lip extending downwardly from said convex arcuate top wall at an angle relative to said second cord portion, said second convex top wall positioned adjacent a top surface of said second cord portion, and said lip extending away from said second cord portion forming a gap between at least a portion of said lip and a portion of a vertical wall of said second cord portion; and wherein a surface of at least one of said first lobe and said second lobe is a guide surface across which said cord slidably passes, said guide surface being made of a harder and/or higher melting temperature material than said preselected material of said base to prevent undue wear to the cord as it passes across at least one of said guide surface.

2. The cord lock of claim 1 wherein the guide surface is metal.

3. The cord lock of claim 1 wherein the guide surface is ceramic.

4. The cord lock of claim 1 wherein said cord guide is molded into said base.

5. The cord lock of claim 1 wherein said preselected material of said base encapsulates a portion of said cord guide while said cord guide surface of said cord guide remains exposed for sliding engagement with said control cords.

6. The cord lock of claim 1 where said cord guide is part of a insert that is removably positioned in said base.

7. The cord guide of claim 1, wherein said base further comprises a step extending substantially from and perpendicularly to said bottom portion.

8. The cord guide of claim 1, wherein said control cord engages said lip when said cord is actuated and when said cord is stationary.

9. A cord guide for an architectural covering and for guiding a control cord between an entry portal and an exit portal in a cord lock body, the cord guide comprising:

a cord lock base comprising:

a substantially planar leg;

a first cord portion extending upward from a first end of the leg;

a bottom portion positioned below and extending from a second end of the first cord portion opposite of the leg;

a second cord portion connected to the bottom portion and terminating in a free end; and a cord guide insert for guiding the control cord, including a first lobe having a first convex arcuate top wall having a length of extension;

a strap extending from a terminal end of the first lobe;

a second lobe having a side extending upwardly from and substantially perpendicular to the strap and having second convex arcuate top wall having a length of extension where the length of extension of the second convex arcuate top wall forms an angle relative to the length of extension of the first convex arcuate top wall;

an end forming a lip extending downwardly from the second convex arcuate top wall at an angle relative to the second cord portion, wherein the cord lock body is a first material and at least a surface of each of the arcuate top walls of the first and second lobes is a second material harder than the first material;

the cord guide insert is positioned on top of the cord lock base and the first lobe is positioned adjacent a top surface of the first cord portion, such that a bottom portion of the first lobe is substantially coextensive with the top surface of the first cord portion, the second convex top wall is positioned adjacent a top surface of the second cord portion, and the lip extending away from the second cord portion forming a gap between at least a portion of the lip and a portion of a vertical wall of the second cord portion; and the control cord extends from the entry portal to the exit portal and contacts both the first convex arcuate top wall and the second convex arcuate top wall.

10. The cord guide of claim 9, wherein the control cord spans directly from the first convex arcuate top wall to the second convex arcuate top wall.

11. The cord guide of claim 9, wherein the control cord engages a guide surface between the first lobe and the second lobe.

12. The cord guide of claim 9 wherein the length of extension of the first convex arcuate top has a positive slope, and the length of extension of the second convex arcuate top wall has a negative slope to form the angle.

13. The cord guide of claim 9, wherein the length of extension of the first lobe and the length of extension of the second lobe are spaced apart and at least partially coextensive in a direction of a length of the control cord.

14. The cord guide of claim 13, wherein the length of extension of the first lobe and the length of extension of the second lobe are not parallel.

15. The cord guide of claim 11, wherein the length of extension of the first lobe and the length of extension of the second lobe are at least partially coextensive.

* * * * *